US011015376B2

(12) United States Patent
Rankin, Sr.

(10) Patent No.: US 11,015,376 B2
(45) Date of Patent: May 25, 2021

(54) SECURITY LOCK FOR DOOR

(71) Applicant: David Daniel Rankin, Sr., Yadkinville, NC (US)

(72) Inventor: David Daniel Rankin, Sr., Yadkinville, NC (US)

( * ) Notice: Subject to any disclaimer, the term of this patent is extended or adjusted under 35 U.S.C. 154(b) by 70 days.

(21) Appl. No.: 16/009,551

(22) Filed: Jun. 15, 2018

(65) Prior Publication Data

US 2019/0264480 A1 Aug. 29, 2019

Related U.S. Application Data

(60) Provisional application No. 62/710,656, filed on Feb. 23, 2018.

(51) Int. Cl.

| | |
|---|---|
| ***E05C 1/04*** | (2006.01) |
| ***E05C 19/00*** | (2006.01) |
| ***E05B 35/00*** | (2006.01) |
| ***E05B 63/18*** | (2006.01) |
| ***E05B 19/20*** | (2006.01) |
| ***E05C 17/48*** | (2006.01) |
| *E05B 63/00* | (2006.01) |

(52) U.S. Cl.

CPC ..... *E05C 19/003* (2013.01); *E05B 19/20* (2013.01); *E05B 35/008* (2013.01); *E05B 63/18* (2013.01); *E05C 1/04* (2013.01); *E05C 17/48* (2013.01); *E05B 2063/0039* (2013.01)

(58) Field of Classification Search

CPC ..... E05C 1/04; E05C 19/003; E05C 19/20; E05C 17/48; E05B 35/008; E05B 63/18; E05B 2063/0039

USPC .... 70/91; 292/164, 177, 262, 265, 268, 269, 292/273, 338, 339, DIG. 15

See application file for complete search history.

(56) References Cited

U.S. PATENT DOCUMENTS 788,950 A 5/1905 Sargent
1,515,091 A * 11/1924 Brower ..... E05C 17/44 292/204

(Continued)

FOREIGN PATENT DOCUMENTS

NL 7413322 A 4/1975

OTHER PUBLICATIONS

European search report in related EP Application No. 18189281.1, dated Feb. 18, 2019, 5 pages.

(Continued)

*Primary Examiner* — Suzanne L Barrett
(74) *Attorney, Agent, or Firm* — Shumaker, Loop & Kendrick, LLP

(57) ABSTRACT

A security lock for a door is provided having a bracket on the interior side of the door with a locking bolt mounted in the bracket. The bolt is adapted for movement between a raised, unlocked position above a cavity on the floor below the bracket and a lowered, locked position where the bolt is in the cavity to prevent the door from being opened. A bolt restraint is mounted on the bracket and cooperates with the bracket to maintain the bolt in its unlocked position. The bolt restraint, for example, a spring-loaded ball that engages an annular recess in the bolt, releases the bolt into its locked position when a downward force is applied to the bolt. The locking bolt has an enlarged flange that stops movement of the bolt into the cavity beyond a predetermined location on the bolt.

3 Claims, 8 Drawing Sheets

(56) References Cited

U.S. PATENT DOCUMENTS 1,561,018 A * 11/1925 Peelle ..... B66B 13/18 292/177
1,723,007 A * 8/1929 Bittorf ..... E05B 17/2076 292/57
1,768,326 A * 6/1930 Miller ..... E05C 17/446 292/153
1,792,540 A * 2/1931 Johnson ..... E05C 1/04 292/57
1,808,393 A * 6/1931 Wecker ..... E05C 17/443 292/338
2,468,969 A * 5/1949 Galey ..... E05C 17/446 292/144
D167,938 S 10/1952 Grindstad
3,347,582 A 10/1967 Cleff
3,642,251 A * 2/1972 Niederholtmeyer .... B66F 15/00 254/131
3,791,687 A * 2/1974 Schroeder ..... E05C 17/56 292/251.5
3,989,286 A 11/1976 Cleff
4,050,723 A 9/1977 Papadatos
D250,247 S 11/1978 Pastva
4,601,502 A * 7/1986 Van Dyke ..... E05C 17/48 16/82
D290,579 S 6/1987 Crisp, Jr. et al.
5,398,982 A * 3/1995 Watson, Jr. ..... E05C 3/048 292/259 R
5,685,208 A 11/1997 Tidwell
5,727,822 A 3/1998 Truong
5,799,367 A * 9/1998 Simon ..... E05C 17/46 16/86 A
5,908,213 A 6/1999 Tippetts et al.
5,983,680 A 11/1999 Del Nin
D422,664 S * 4/2000 Tate ..... D21/793
6,108,989 A * 8/2000 Kordes ..... E04B 2/827 160/225
6,340,185 B1 1/2002 Truong
6,557,912 B1 5/2003 Truong
6,572,160 B2 * 6/2003 Bunting ..... E05C 17/48 16/82
7,488,013 B2 * 2/2009 Urpolahti ..... E04B 2/827 292/145
7,513,542 B2 * 4/2009 Schumm ..... E05C 17/446 292/163
D605,720 S * 12/2009 McLane ..... D21/793
D717,641 S 11/2014 Hugo
D719,436 S 12/2014 Roggero
D722,495 S 2/2015 Hugo
D733,520 S 7/2015 Barna
10,316,556 B2 * 6/2019 Richmond ..... E05C 19/004
2003/0234545 A1 12/2003 Laufer
2011/0179720 A1 7/2011 Zijlstra
2014/0217754 A1 * 8/2014 Taylor ..... E05C 19/003 292/288
2014/0265363 A1 * 9/2014 Mock ..... E05B 53/001 292/177
2014/0306466 A1 * 10/2014 Couturier ..... E05C 19/184 292/338
2014/0325765 A1 11/2014 Weddle
2015/0211269 A1 * 7/2015 Gehrke ..... E05C 17/48 292/338

OTHER PUBLICATIONS

Levine, Jerry; Locksmithing Etc.—News you can use! 2001 Ford Thunderbird:, Locksmith Ledger International, Cygnus Business Media, Fort Atkinson, WI, US. vol. 61, No. 3, Feb. 1, 2001; pp. 54-56, 58/59 (XP001124402; IDDN: 1050-2254).

International Search Report for related International Application No. PCT/US2019/018144; dated Apr. 17, 2019; 10 pages.

Preliminary Report and Written Opinion of the International Search Authority in related International Application No. PCT/US2019/018144 filed Feb. 15, 2019;Written Opinion Report dated Apr. 17, 2020; 9 pages.

* cited by examiner

SECURITY LOCK FOR DOOR

CROSS REFERENCE TO RELATED PATENT APPLICATIONS

This application claims the benefit of and priority to U.S. Provisional Patent Application No. 62/710,656, filed Feb. 23, 2018, herein expressly incorporated by reference in its entirety.

TECHNICAL FIELD AND BACKGROUND OF THE INVENTION

This invention relates to a security lock for use on a door, such as a classroom door, to prevent entry by an unwelcome intruder. More particularly, the invention pertains to a security lock that can be locked from inside of the classroom in an emergency situation and later unlocked from the outside of the door using a special tool.

School shooting events have garnered wide publicity in recent years. In some tragic events, students were trapped inside classrooms, unable to bar entry to an intruder. This concern has spurred discussion and media attention about protecting students in the classroom. One such avenue of discussion revolves around teachers and students securing themselves inside of classrooms.

Traditional doorknob locks are often installed such that they lock from the outside of a door rather than from the inside. Other classrooms do not have locks installed on the classroom doors at all. Replacing existing locks on all classroom doors can be costly and time consuming.

Other types of common door locks, such as barrel bolts and latches as well as recent aftermarket door locking devices pose safety concerns due to the inability to unlock the door from the outside by school personnel or law enforcement. Additionally, local fire safety standards often limit the types of safety mechanisms and locking hardware that are allowed to be installed on classroom doors.

SUMMARY OF THE INVENTION

It is therefore an object of the present invention to provide a door locking mechanism that can be engaged quickly and easily in the event of an attempted intruder into a classroom.

It is another object of the present invention to provide the ability to unlock the door from outside of the classroom using a separate tool.

It is another object of the present invention to provide for low cost and quick installation of the security lock.

These and other objects and advantages of the present invention are achieved in the preferred embodiments set forth below by providing a security lock for a door having a bracket on the interior side of the door with a locking bolt mounted in the bracket. The bolt is adapted for movement between a raised, unlocked position above a cavity on the floor below the bracket and a lowered, locked position where the bolt is in the cavity to prevent the door from being opened. A bolt restraint is mounted on the bracket and cooperates with the bracket to maintain the bolt in its unlocked position. The bolt restraint releases the bolt into its locked position when a downward force is applied to the bolt. The locking bolt has an enlarged flange that stops movement of the bolt into the cavity beyond a predetermined location on the bolt.

According to another embodiment, the security lock has a protective bushing fitted into the cavity in the floor.

According to another embodiment, the security lock includes an unlocking tool that is inserted under the door from a position proximate to the outside of the door and is manually operated to lever the bolt upwardly out of the cavity.

According to another embodiment, the security lock includes an unlocking tool having a thin, curved strip with an opening in one end adapted to fit onto the bolt at a location below the flange.

According to another embodiment, the security lock includes a bolt with an annular recess at a location along the length of the bolt such that the annular recess communicates with the bolt restraint. Together the annular recess and the bolt restraint maintain the bolt in the unlocked position. The bolt restraint is adapted to release the bolt by downward pressure sufficient to overcome the interference between the bolt restraint and the annular recess.

According to another embodiment, the security lock has a bolt restraint that includes a spring carried by the bracket and a ball. The ball is urged by the spring to partially reside in the annular recess and apply a perpendicular interference force to the annular recess to hold the bolt in the unlocked position.

According to another embodiment, the security lock has a bracket on the interior side of the door with a locking bolt mounted in the bracket. The bolt is adapted for movement between a raised, unlocked position above a cavity on the floor below the bracket and a lowered, locked position where the bolt is in the cavity to prevent the door from being opened. A bolt restraint is mounted on the bracket and cooperates with the bracket to maintain the bolt in its unlocked position. The bolt restraint releases the bolt into its locked position when a downward force is applied to the bolt. The locking bolt has an enlarged flange that stops movement of the bolt into the cavity beyond a predetermined location on the bolt. An unlocking tool having a thin, curved strip with an opening in a first end is adapted to fit onto the bolt at a location below the flange. The unlocking tool is adapted to be inserted under the door from a position proximate to the outside of the door and manually operated to engage the flange and lever the bolt upwardly out of the cavity into the unlocked position.

According to another embodiment, the security lock has a bracket on the interior side of the door with a locking bolt mounted in the bracket. The bolt is adapted for movement between a raised, unlocked position above a cavity on the floor and a lowered, locked position where the bolt is in the cavity to prevent the door from being opened. An annular recess is located on the bolt at a location where the bolt is in communication with the bracket while in the unlocked position. A spring is carried by the bracket and a ball is urged by the spring to partially reside in the annular recess and apply a perpendicular interference force to the annular recess to hold the bolt in the unlocked position. The spring and ball release the bolt when a downward force is applied to the bolt sufficient to overcome interference between the ball and the annular recess. The locking bolt has an enlarged flange that stops movement of the bolt into the cavity beyond a predetermined location on the bolt.

BRIEF DESCRIPTION OF THE DRAWING FIGURES

The present invention is best understood when the following detailed description of the invention is read with reference to the accompanying drawings, in which.

DETAILED DESCRIPTION OF THE PREFERRED EMBODIMENT

Figure 1:
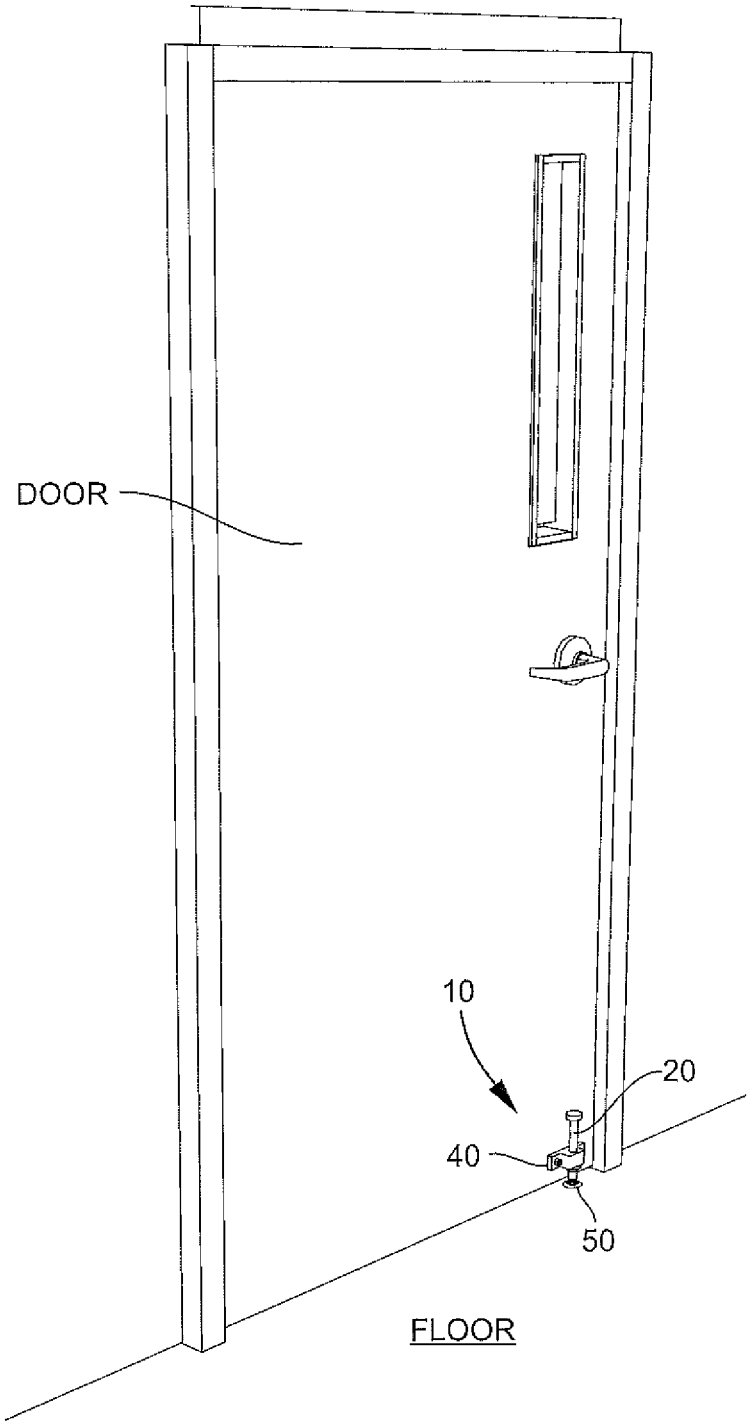
FIG. 1 is an environmental perspective view showing the safety stop in an unlocked position.

Referring now to the drawings, a security lock 10 is shown in FIG. 1 installed on an interior side of a classroom door in its preferred embodiment. The security lock 10 is in a raised, unlocked position allowing the door to open and close freely. A bracket 40 is mounted on a lower portion of the door and allows a locking bolt 20 to slide through the bracket 40 in a perpendicular orientation to the floor. When in the unlocked position, the bolt 20 is held above a bushing 50 installed into the floor beneath the door.

Figure 2:
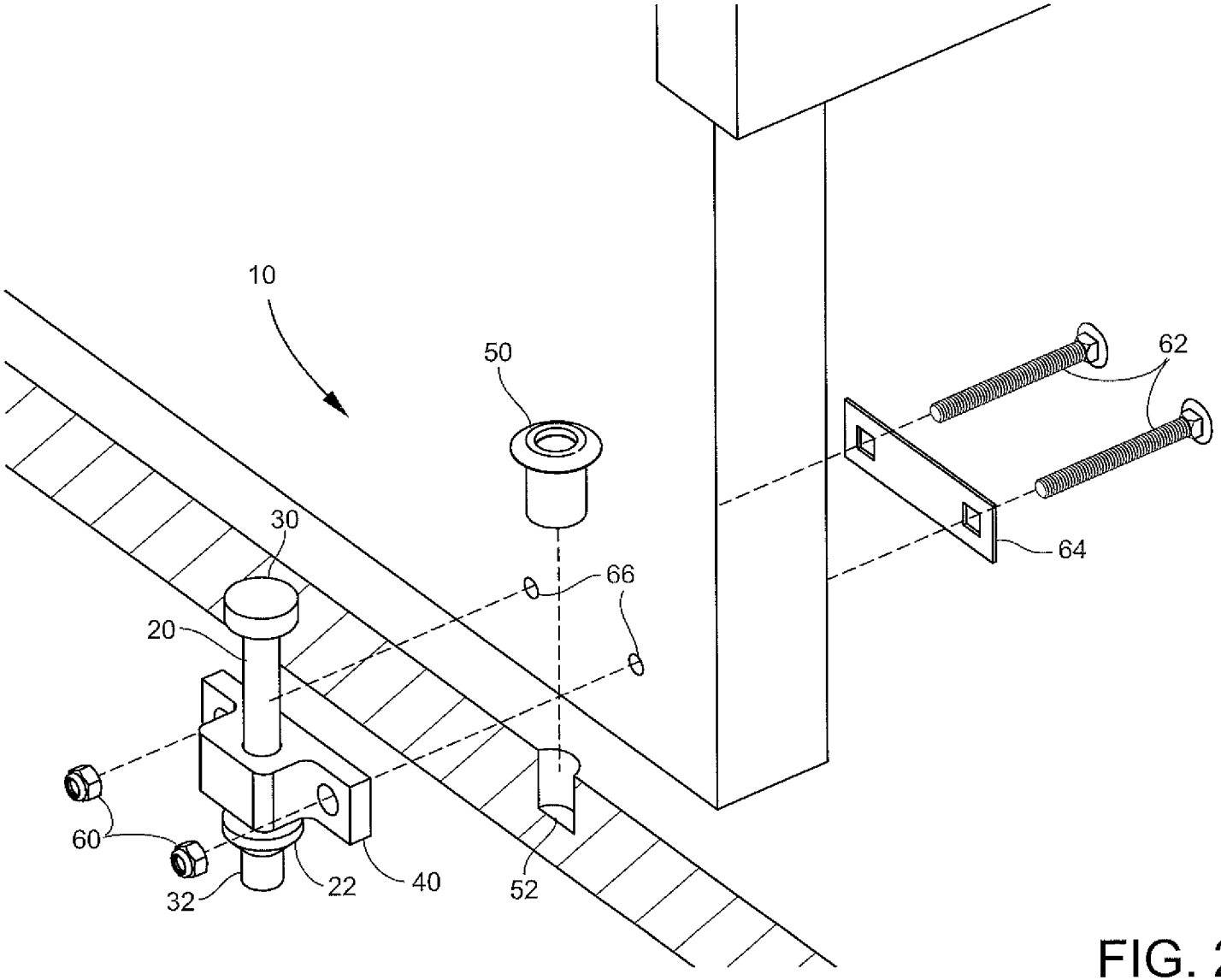
FIG. 2 is an exploded perspective view of the security lock, showing the manner of installation.

The assembly of the security lock 10 is shown in FIG. 2. The bracket 40 is affixed to the inside of the door by two threaded bolts 62. These threaded bolts 62 pass through a mounting plate 64 located on an outside of the door and through two corresponding holes 66 in the door. The threaded bolts 62 then fasten the bracket 40 to the inside of the door with two nuts 60. The bushing 50 is inserted into a cavity 52 in the floor which is positioned below the bolt 20 so that the bolt 20 can slide into the bushing 50. The bolt 20 has a pointed lower end 32 that enables proper location on the floor of the cavity 52 prior to the installation of the bushing 50.

Figure 3:
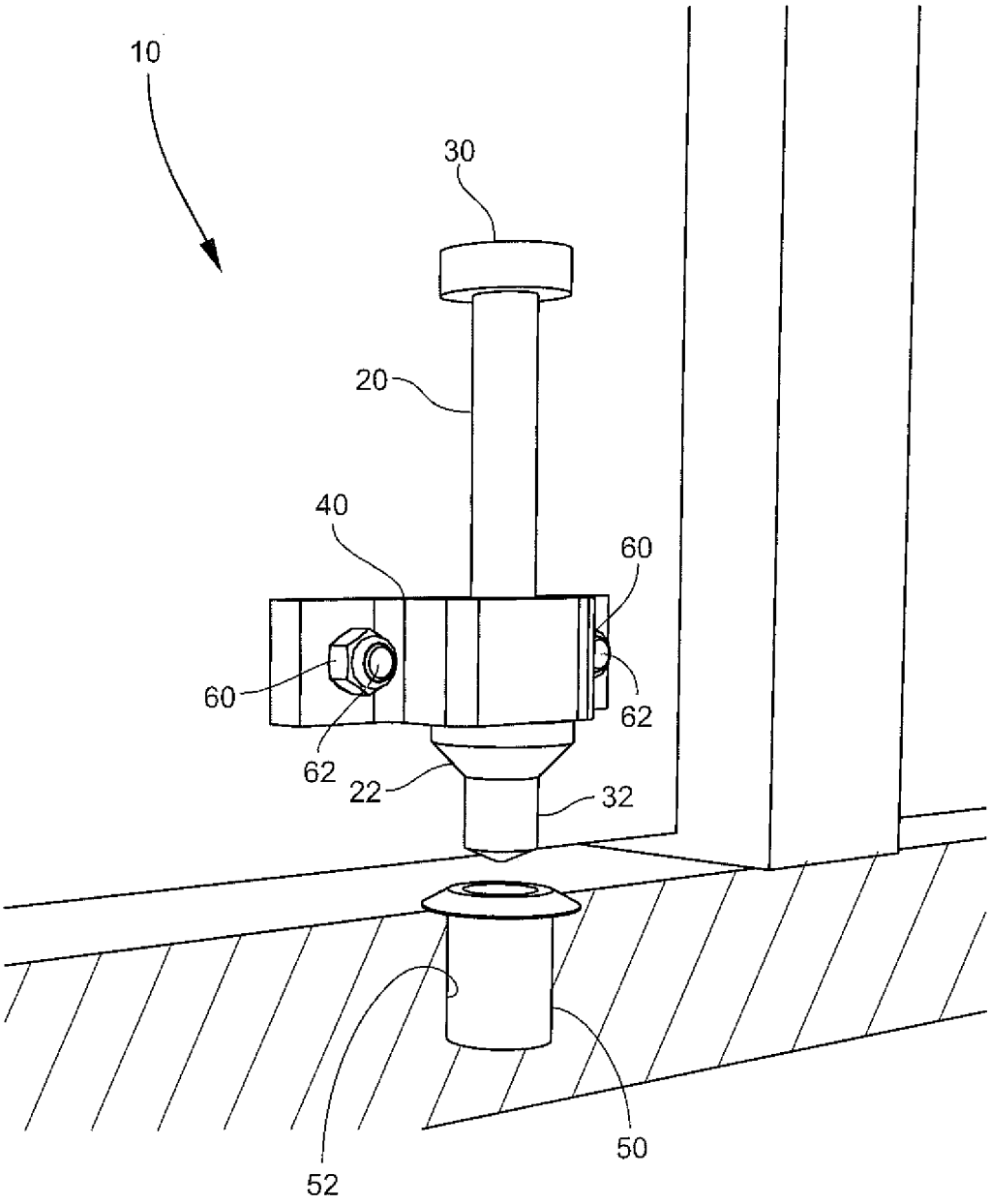
FIG. 3 is an enlarged perspective view of the security lock shown in FIG. 1 in an unlocked position.
Figure 4:
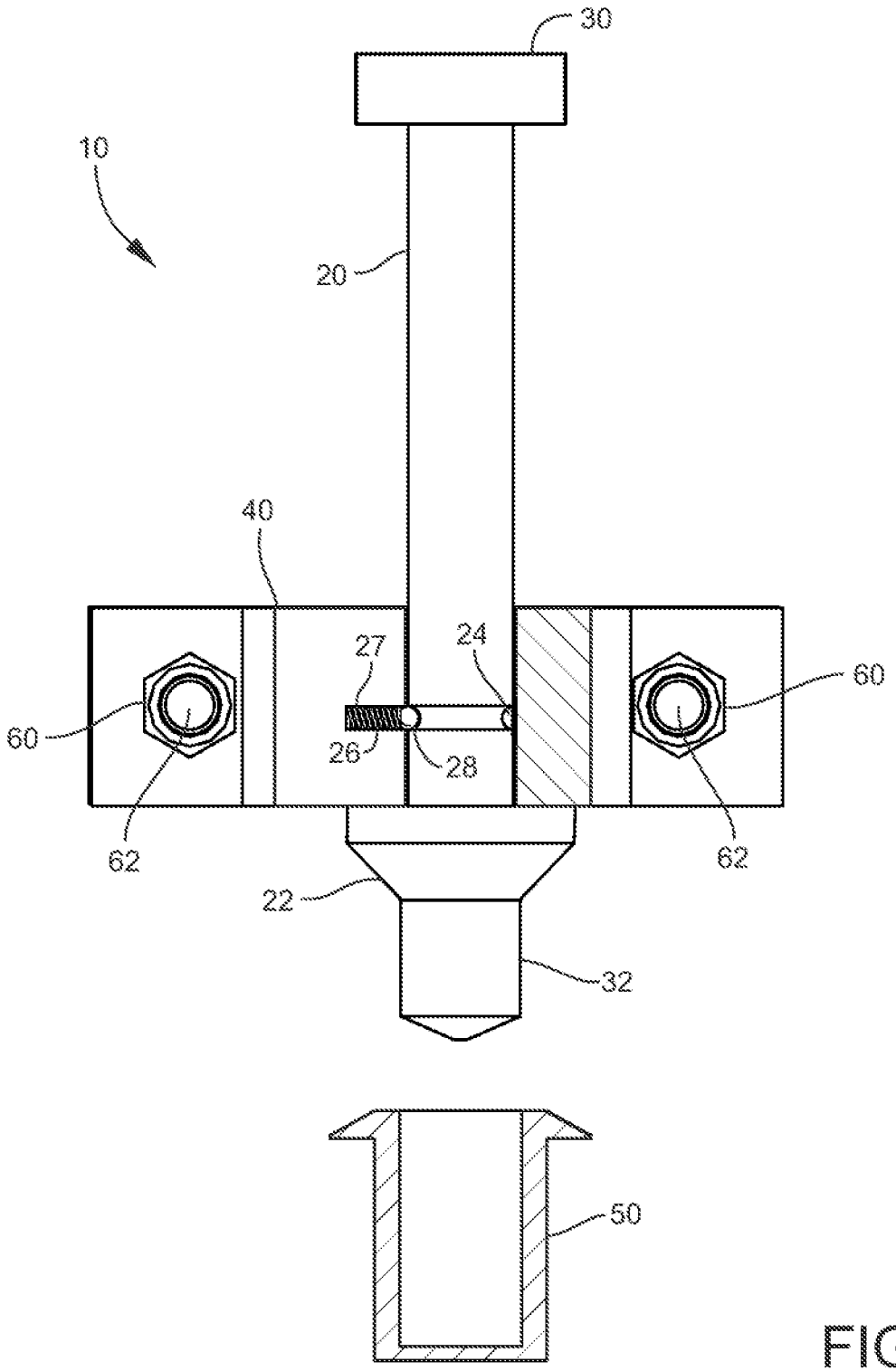
FIG. 4 is a partial vertical cross sectional view of the security lock in an unlocked position.

FIGS. 3 and 4 also show the bolt 20 in its raised, unlocked position. The bolt 20 has a lower end 32 with a diameter that fits into the bushing 50 and a bolt head 30 on the opposite end. Proximate to the lower end 32 is an enlarged, downwardly-tapered annular flange 22 that serves as a stop to prevent the bolt 20 from sliding further into the bushing 50. The flange 22 also functions as a gripping surface for unlocking the door from the outside, as described below. An annular recess 24 is located in the surface of the bolt 20 between the flange 22 and the bolt head 30.

As shown in FIG. 4, the bolt 20 is held in place by a bolt restraint that includes a ball 28 and a spring 26. The spring 26 is embedded in a recess 27 inside of the bracket 40 and provides an force that is perpendicular to the bolt 20. The ball 28 is positioned between the spring 26 and the annular recess 24 and fits partially inside of the annular recess 24. Interference between the ball 28 and the annular recess 24 due to the force being applied by the ball 28 against the spring 26 perpendicular to the direction of movement of the bolt 20 holds the bolt 20 in its unlocked position.

Figure 5:
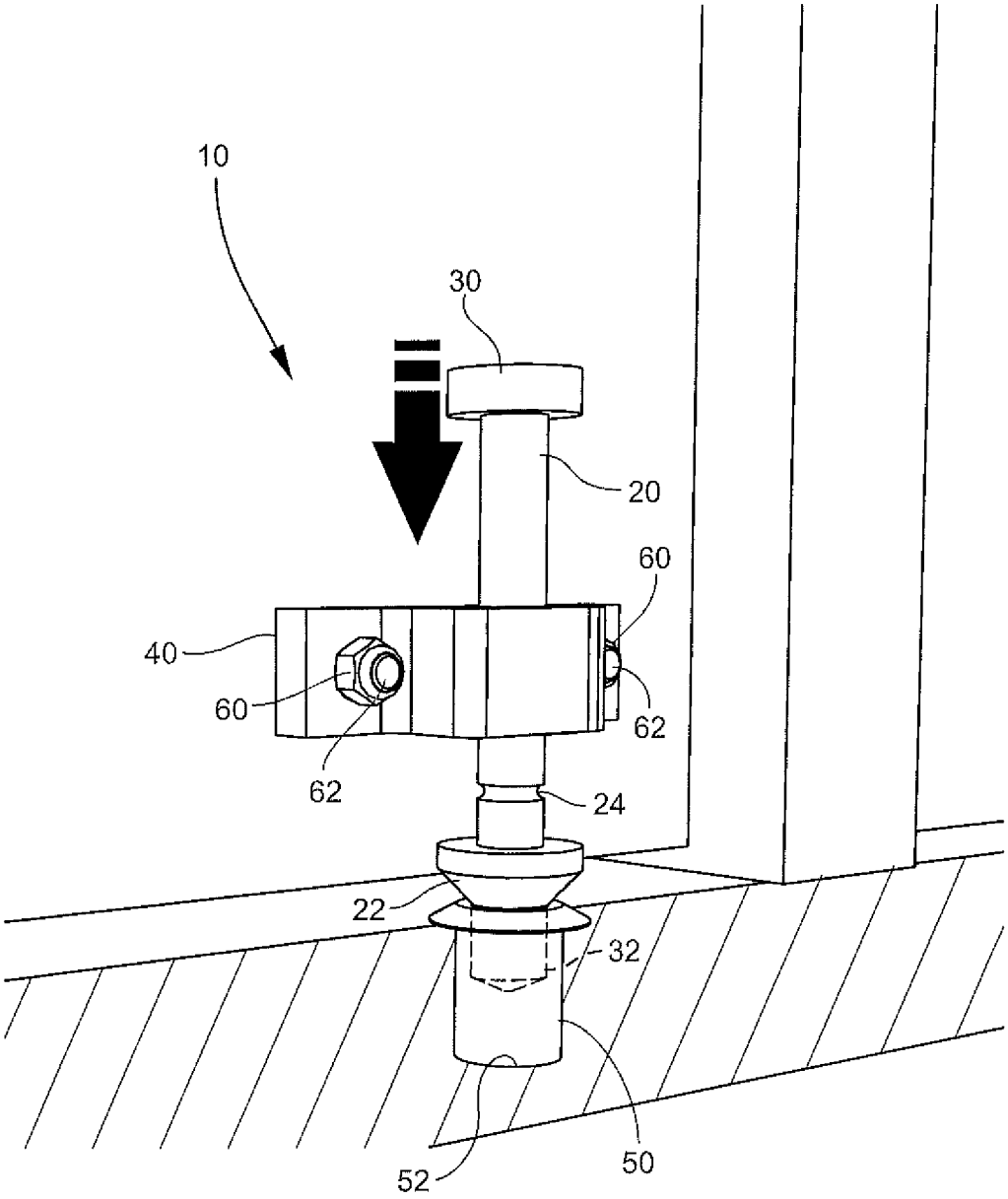
FIG. 5 is an enlarged perspective view of the security lock shown in FIG. 1 in a locked position.

Referring now to FIG. 5, the security lock 10 is shown in a lowered, locked position preventing the door from being opened. The lower end 32 of the bolt 20 is inside of the bushing 50 due to the application of a downward force on the bolt head 30 sufficient to overcome the interference between the annular recess 24 and the ball 28 caused by the perpendicular force applied to the spring 26 by the ball 28.

In the event of an emergency, the downward force can be quickly applied to the bolt head 30 by a foot, for example. Note that when the bolt 20 is in the locked position the annular recess 24 is no longer engaged with the ball 28 and is visible below the bracket 40.

Figure 6:
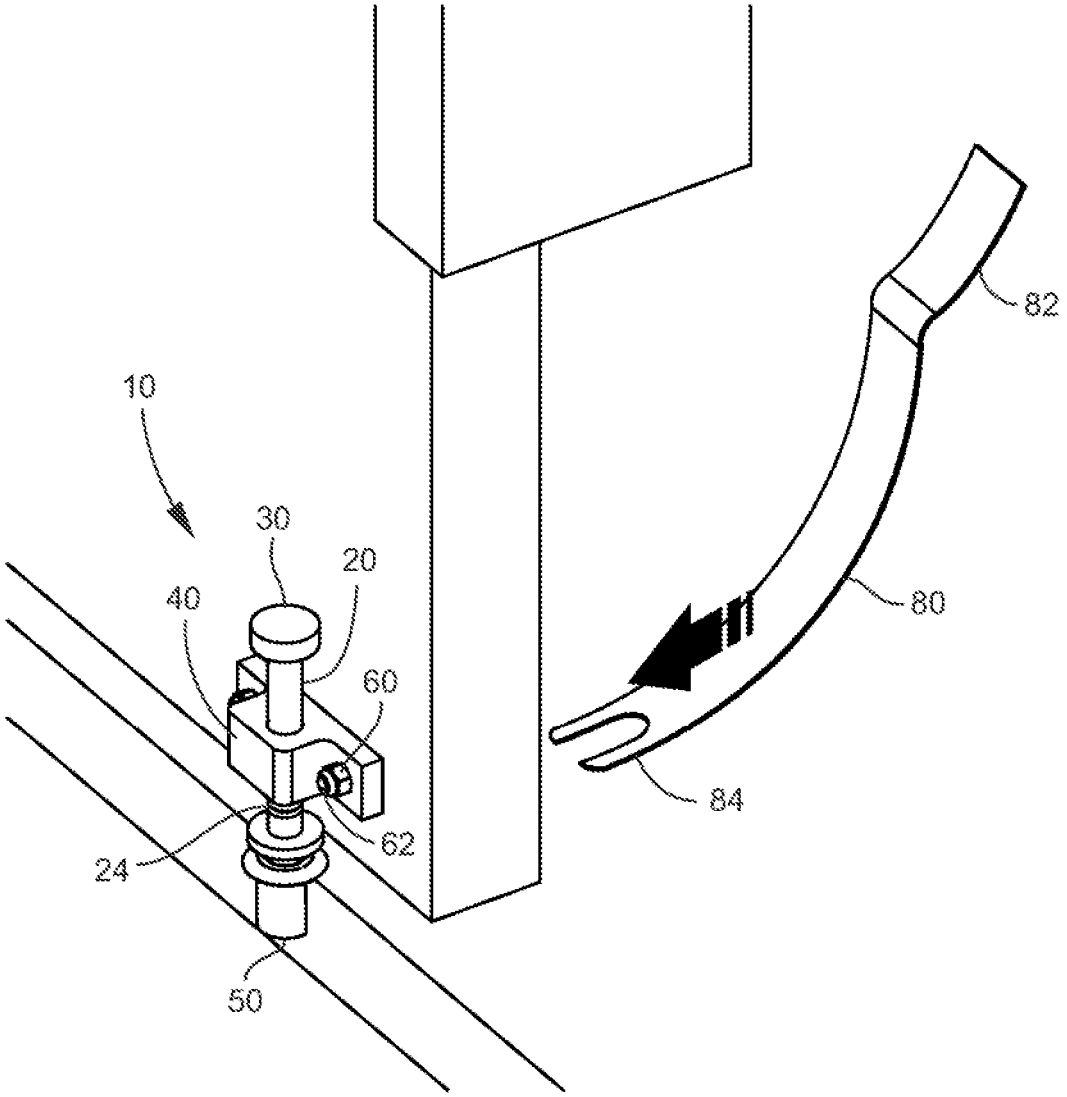
FIGS. 6-8 are sequential perspective views showing the security lock being unlocked from outside of the door.
Figure 7:
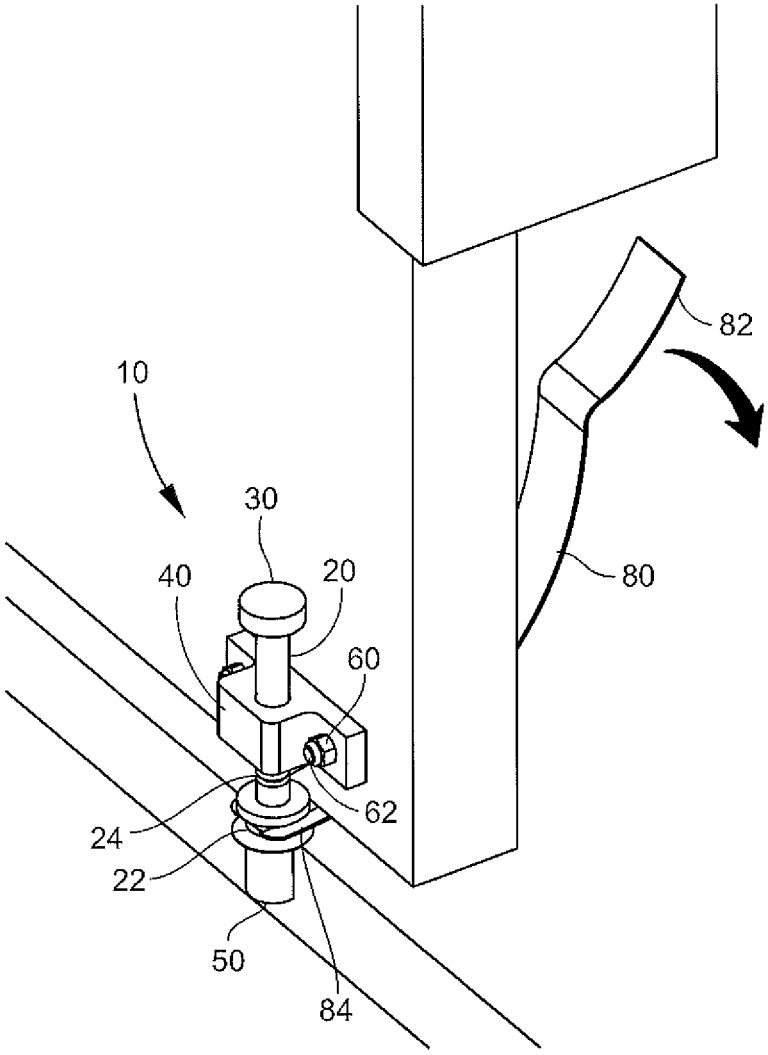
Figure 8:
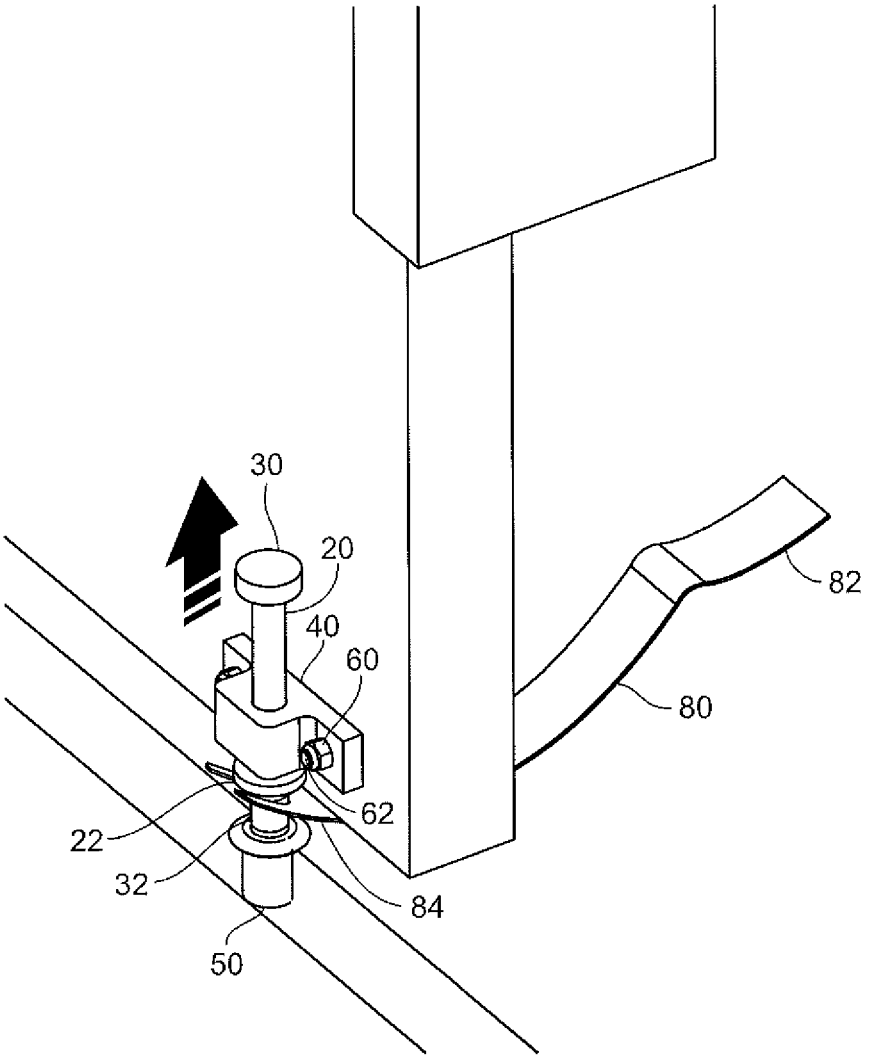

FIGS. 6-8 show the process of unlocking the security lock 10 from outside of the door. An unlocking tool 80 is used to raise the bolt 20 until the ball 28 engages with the annular recess 24 and holds the bolt 20 in the unlocked position. The unlocking tool 80 is a thin, curved strip with a hand gripping end 82 and a two pronged flange gripping end 84, The flange gripping end 84 is thin enough to slide under the door from the outside and engage with the flange 22 between the two prongs. The bushing 50 has an upward flare that cooperates with the flare of the flange 22 to form a "V" that guides the unlocking tool 80 into position. Once the flange gripping end 84 of the unlocking tool 80 is under the door and engaging with the flange 22 of the bolt 20 manual downward force is applied to the hand gripping end 82 of the unlocking tool 80. When a sufficient downward force is applied on the hand gripping end 82, the flange 22 is levered out of the bushing 50 and raised until the annular recess 24 and the ball 28 engage and hold the bolt 20 in its unlocked position enabling the door to open and close freely.

A security lock according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

What is claimed is:

1. A security lock for a door, comprising;

(a) a bracket for being secured to an interior side of the door proximate a bottom of the door;

(b) a locking bolt for being mounted in the bracket and adapted for manual movement between a raised, unlocked position above a cavity positioned below the bracket in a floor without the use of a force multiplier, and a lowered, locked position without the use of a force multiplier, with the bolt positioned in the cavity to prevent the door from being opened;

(c) a laterally-operating bolt restraint mounted on the bracket and laterally-engaging a sidewall of the bolt for maintaining the bolt in the unlocked position above the cavity and adapted to release the bolt for movement into its lowered, locked position upon a downward force being applied to the bolt;

(d) the locking bolt including an enlarged flange adapted to stop movement of the bolt into the cavity beyond a predetermined location on the bolt;

(e) a protective bushing adapted for being fitted into the cavity in the floor for receiving the bolt; and (f) an unlocking tool having a thin, curved strip including an opening in a first end of the strip and adapted to fit onto the bolt at a location below the flange and adapted for being inserted under and through an existing space between floor and the door from a position proximate to an exterior side of the door and manually operated to engage the enlarged flange of the locking bolt to lever the bolt upwardly out of the cavity into the unlocked position without damage to the lock or the door.

2. A security lock for a door according to claim 1, wherein the bolt includes an annular recess in the bolt at a location along a length of the bolt such that the annular recess communicates with the laterally-extending bolt restraint to maintain the bolt in the unlocked position and is adapted to release the bolt by downward pressure applied to the bolt sufficient to overcome interference between the bolt restraint and the annular recess.

3. A security lock for a door according to claim 1, wherein the bolt restraint comprises a spring carried by the bracket and a ball urged by the spring to partially reside in the annular recess and apply a perpendicular interference force to the annular recess for maintaining the bolt in the unlocked position.

* * * * *